US012496628B2

(12) United States Patent
Kimura et al.

(10) Patent No.: US 12,496,628 B2
(45) **Date of Patent: *Dec. 16, 2025**

(54) WORKPIECE PROCESSING APPARATUS

(71) Applicants: JAPAN AVIATION ELECTRONICS INDUSTRY, LIMITED, Tokyo (JP); The University of Tokyo, Tokyo (JP)

(72) Inventors: Shinya Kimura, Tokyo (JP); Tsuyoshi Furushima, Tokyo (JP)

(73) Assignees: JAPAN AVIATION ELECTRONICS INDUSTRY, LIMITED, Tokyo (JP); THE UNIVERSITY OF TOKYO, Tokyo (JP)

( * ) Notice: Subject to any disclaimer, the term of this patent is extended or adjusted under 35 U.S.C. 154(b) by 245 days.

This patent is subject to a terminal disclaimer.

(21) Appl. No.: 18/201,470

(22) Filed: May 24, 2023

(65) Prior Publication Data

US 2023/0381849 A1 Nov. 30, 2023

(30) Foreign Application Priority Data

May 26, 2022 (JP) ..... 2022-086335

(51) Int. Cl.
*B21D 28/00* (2006.01)

(52) U.S. Cl.
CPC ..... *B21D 28/002* (2013.01)

(58) Field of Classification Search
CPC ..... B21D 22/205; B21D 24/14; B21D 24/06
See application file for complete search history.

(56) References Cited

U.S. PATENT DOCUMENTS 3,208,255 A 9/1965 Eugen
4,419,876 A * 12/1983 Spacek ..... B30B 1/32 72/481.2
4,472,955 A 9/1984 Nakamura et al.

FOREIGN PATENT DOCUMENTS

JP S58181431 A 10/1983
JP S61119399 A 6/1986
(Continued)

OTHER PUBLICATIONS

European Office Action dated Jun. 25, 2024, issued in counterpart European Application No. 23174672.8.
(Continued)

*Primary Examiner* — Debra M Sullivan
(74) *Attorney, Agent, or Firm* — Holtz, Holtz & Volek PC

(57) ABSTRACT

A workpiece processing apparatus comprises a base member formed with a hydraulic chamber fillable with liquid, a punch and a piston. The hydraulic chamber has a workpiece processing chamber and a hydraulic-pressure generation chamber. The punch is movable between an initial position which is apart from the workpiece processing chamber and a received position at which the punch is partially received in the workpiece processing chamber. When the punch is moved from the initial position to the received position, the punch presses the workpiece into the workpiece processing chamber. The piston is partially received in the hydraulic-pressure generation chamber and receives a pressing force directed into the hydraulic-pressure generation chamber in a course of movement of the punch from the initial position to the received position, and the piston is moved in accordance with the pressing force and increases hydraulic pressure of the liquid.

20 Claims, 8 Drawing Sheets

(56) References Cited

FOREIGN PATENT DOCUMENTS

| | | | |
|---|---|---|---|
| JP | S62161435 | A | 7/1987 |
| JP | H01186223 | A | 7/1989 |
| JP | H01273624 | A | 11/1989 |
| JP | H02217117 | A | 8/1990 |
| JP | H02229624 | A | 9/1990 |
| JP | H08150426 | A | 6/1996 |
| JP | 2007014987 | A | 1/2007 |
| JP | 2021137851 | A | 9/2021 |
| SU | 1039610 | A1 | 9/1983 |

OTHER PUBLICATIONS

Extended European Search Report (EESR) dated Oct. 13, 2023, issued in counterpart European Application No. 23174672.8.

* cited by examiner

WORKPIECE PROCESSING APPARATUS

CROSS REFERENCE TO RELATED APPLICATIONS

This application is based on and claims priority under 35 U.S.C. § 119 to Japanese Patent Application No. JP 2022-086335 filed May 26, 2022, the content of which is incorporated herein in its entirety by reference.

BACKGROUND OF THE INVENTION

This invention relates to a workpiece processing apparatus configured to use hydraulic pressure to process a workpiece of an object.

For example, this type of workpiece processing apparatus is disclosed in JP H08-150426A (Patent Document 1), the content of which is incorporated herein by reference.

Referring to FIG. 15, Patent Document 1 discloses a workpiece processing apparatus 90 which is an existing typical workpiece processing apparatus configured to use hydraulic pressure to process a material (object) 98. The workpiece processing apparatus 90 comprises a die 91, a blank holder 92, a punch 93 and a hydraulic-pressure control device 95. The die 91 is formed with a hydraulic chamber 94. The hydraulic chamber 94 is filled with liquid such as oil. The hydraulic pressure of the liquid is controlled by the hydraulic-pressure control device 95 which includes a pump and a relief valve. The blank holder 92 can be vertically moved by a power device (not shown). The punch 93 can be vertically moved relative to the blank holder 92 by another power device (not shown). When the blank holder 92 is moved downward, the object 98 is sandwiched between the die 91 and the blank holder 92. Thereafter, when the punch 93 is moved downward, the object is drawn by using hydraulic pressure.

The workpiece processing apparatus 90 disclosed in Patent Document 1 has a complex hydraulic-pressure control mechanism including the pump and the relief valve. However, there is a request for a workpiece processing apparatus having a simpler structure.

SUMMARY OF THE INVENTION

It is therefore an object of the present invention to provide a new workpiece processing apparatus which is configured to use hydraulic pressure to process a workpiece of an object and has a simpler structure.

An aspect of the present invention provides a workpiece processing apparatus configured to use hydraulic pressure to process a workpiece of an object. The workpiece processing apparatus comprises a main member. The main member comprises a base member, a punch and a piston. The base member is formed with a hydraulic chamber. The hydraulic chamber is fillable with liquid. The hydraulic chamber has a workpiece processing chamber and a hydraulic-pressure generation chamber. The workpiece processing chamber and the hydraulic-pressure generation chamber are coupled together and have openings, respectively. The openings open outward from the base member at positions different from each other. The punch is movable between an initial position which is apart from the opening of the workpiece processing chamber and a received position at which the punch is partially received in the workpiece processing chamber through the opening of the workpiece processing chamber. When the punch is moved from the initial position to the received position under a state where the opening of the workpiece processing chamber is covered by the workpiece, the punch presses the workpiece into the workpiece processing chamber. The piston is partially received in the hydraulic-pressure generation chamber through the opening of the hydraulic-pressure generation chamber so that the piston is movable in the hydraulic-pressure generation chamber and partially projects from the hydraulic-pressure generation chamber. When the hydraulic chamber is filled with the liquid, the piston receives a pressing force directed into the hydraulic-pressure generation chamber via a resilient member in a course of movement of the punch from the initial position to the received position, and the piston is moved in accordance with the pressing force and increases hydraulic pressure of the liquid.

The piston of an aspect of the present invention is moved in accordance with the pressing force applied via the resilient member and increases the hydraulic pressure of the liquid. According to this structure, the hydraulic pressure can be prevented from being excessively increased by using the resiliency of the resilient member without providing a relief valve. In addition, since the liquid is kept in the hydraulic chamber because of a structure in which no relief valve is provided, the liquid does not need to be supplied from the outside. Therefore, there is no need to provide a complex hydraulic-pressure control mechanism including a pump and a relief valve. An aspect of the present invention provides a new workpiece processing apparatus which is configured to use hydraulic pressure to process a workpiece of an object and has a simpler structure.

An appreciation of the objectives of the present invention and a more complete understanding of its structure may be had by studying the following description of the preferred embodiment and by referring to the accompanying drawings.

Figure 1:
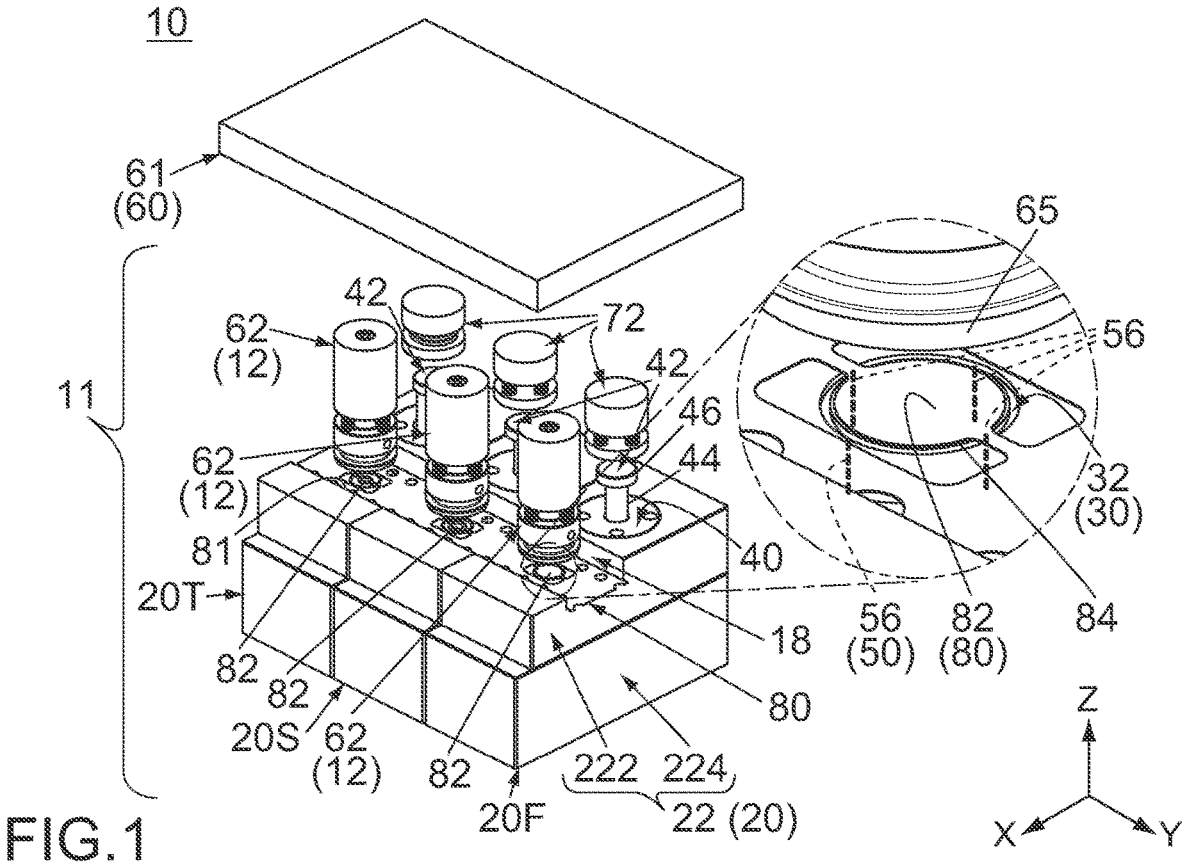
FIG. 1 is a perspective view showing a workpiece processing apparatus according to an embodiment of the present invention, wherein an object is placed on the workpiece processing apparatus, although illustrated punches and illustrated spacers are apart from a slider, the actual punches and the actual spacers are fixed to the slider, a part of the workpiece processing apparatus enclosed by chain dotted lines is enlarged and illustrated, and in the enlarged view, positions of hidden branch channels are illustrated with dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Referring to FIG. 1, a workpiece processing apparatus 10 according to an embodiment of the present invention is a workpiece processing apparatus configured to use hydraulic pressure to process a workpiece (blank) 82 of an object 80. "Hydraulic pressure" of the present embodiment is a pressure applied to the workpiece 82 by liquid 50L (see FIG. 5) as described later and is a concept including "hydraulic counterpressure OP" and "peripheral hydraulic pressure PP" described later. The object 80 of the present embodiment is a single metal plate and has a thin flat-plate shape before being processed. Referring to FIG. 1 together with FIG. 4, the illustrated object 80 has a carrier 81 and three of the workpieces 82 connected to the carrier 81.

The workpiece processing apparatus 10 of the present embodiment is suitable for progressive processing of the object 80. However, the present invention is not limited thereto but is applicable to an apparatus which performs transfer processing to the object 80. Moreover, the object 80 may be one of the workpieces 82 separated from the carrier 81. Thus, the workpiece processing apparatus 10 may be an apparatus which perform single-shot processing to only one of the workpieces 82.

Figure 2:
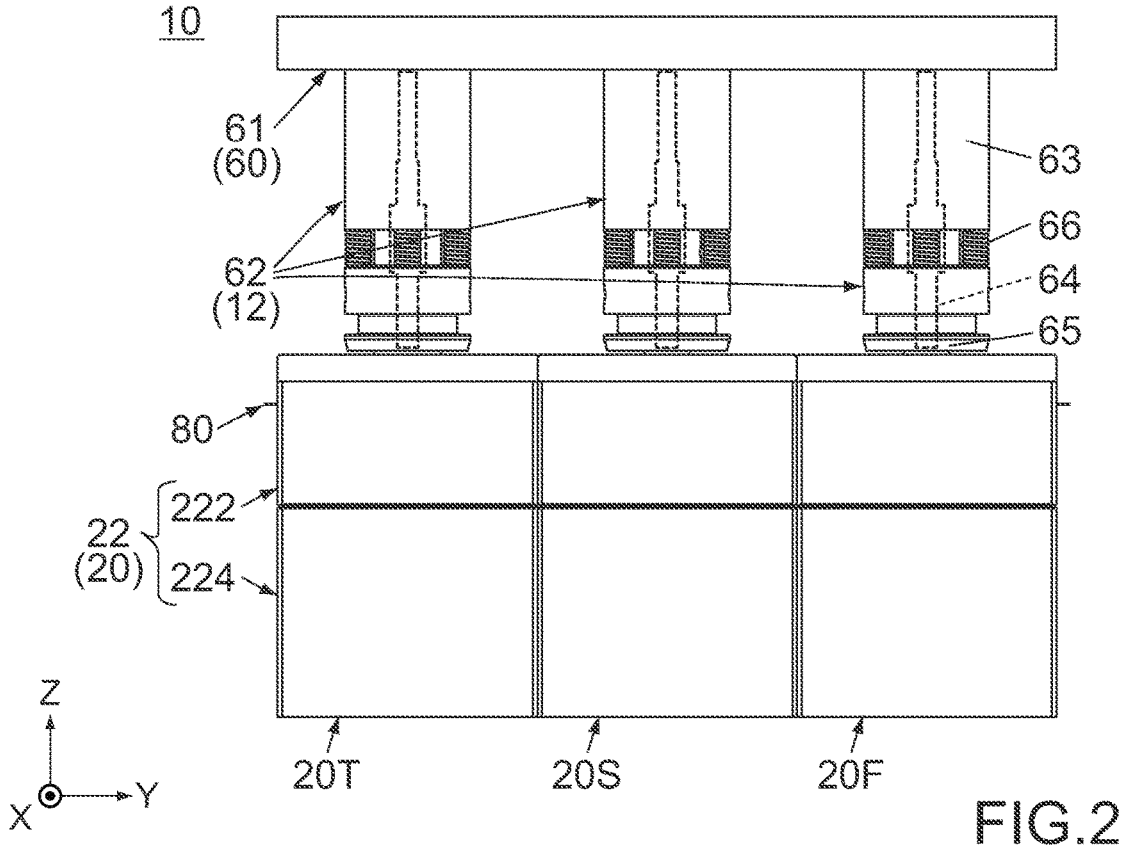
FIG. 2 is a front view showing the workpiece processing apparatus of FIG. 1, wherein positions of hidden punches are illustrated with dashed line.
Figure 3:
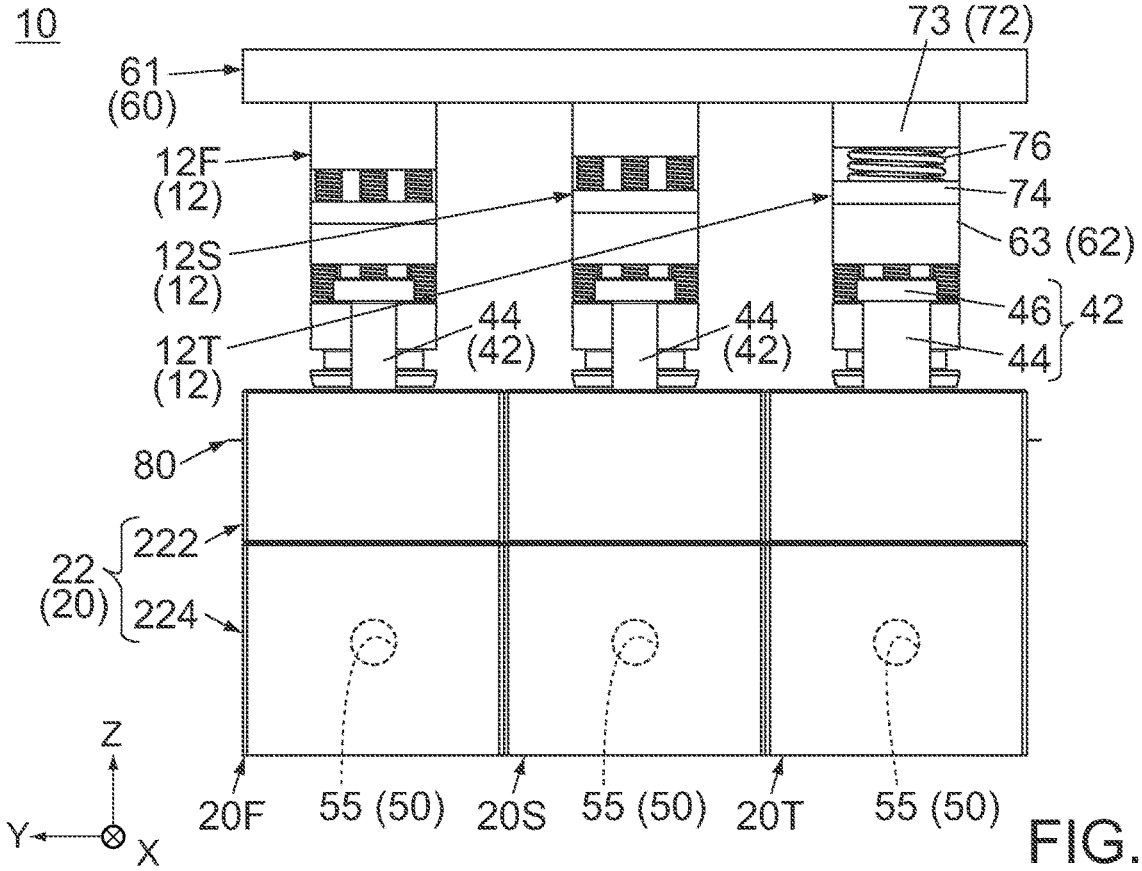
FIG. 3 is a rear view showing the workpiece processing apparatus of FIG. 1, wherein positions of hidden hydraulic chambers are illustrated with dashed line.

As shown in FIGS. 1 to 3, the workpiece processing apparatus 10 of the present embodiment comprises one base member 20, one movable member 60 and three pistons 42 each made of metal. The movable member 60 is located above the base member 20 and the pistons 42 in an upper-lower direction. The upper-lower direction of the present embodiment is the Z-direction. In the present embodiment, "upward" means the positive Z-direction, and "downward" means the negative Z-direction. The upper-lower direction is preferred to be aligned with the gravity direction. However, the present invention is not limited thereto. For example, the upper-lower direction may intersect with the gravity direction within a range in which the object 80 can be processed.

As shown in FIG. 1, the base member 20 is formed with a channel 18. The channel 18 is a space recessed downward. The channel 18 continuously extends along a lateral direction perpendicular to the upper-lower direction and opens outward at opposite ends thereof in the lateral direction. The lateral direction of the present embodiment is the Y-direction. The channel 18 has a bottom surface which extends along a horizontal plane (XY-plane) perpendicular to the upper-lower direction. The object 80 is placed on the bottom surface of the channel 18. The workpieces 82 of the object 80 are arranged in the lateral direction.

Referring to FIGS. 1 to 3, the workpiece processing apparatus 10 of the present embodiment comprises only the base member 20, the movable member 60 and the pistons 42 described above. The workpiece processing apparatus 10 has a small size of at most several tens of centimeters in the lateral direction. However, the present invention is not limited thereto but is applicable to a large workpiece processing apparatus 10. Moreover, the workpiece processing apparatus 10 may further comprise another member in addition to the aforementioned members.

The base member 20 of the present embodiment comprises three base members 20F, 20S and 20T, namely a first member (base member) 20F, a second member (base member) 20S and a third member (base member) 20T. The base members 20F, 20S and 20T are arranged in the lateral direction. The three base members 20F, 20S and 20T can process the three workpieces 82, respectively.

A forming process of the present embodiment includes three processing steps. The workpiece processing apparatus 10 of the present embodiment comprises the three base members 20F, 20S and 20T which are used in the three processing steps, respectively. The base members 20F, 20S and 20T of the present embodiment are formed separately from each other and are arranged in the lateral direction with no gap left therebetween. According to the present embodiment, two or more of the base members 20F, 20S, 20T, etc. can be arranged in accordance with the number of the processing steps. However, the present invention is not limited thereto. For example, the base members 20F, 20S and 20T may be formed integrally with each other. When the number of the processing steps is one, the workpiece processing apparatus 10 may comprise only the one base member 20F.

The base members 20F, 20S and 20T of the present embodiment have outlines same as each other and have structures similar to each other. However, the present invention is not limited thereto. For example, the base members 20F, 20S and may have outlines different from each other and may have structures different from each other.

Hereafter, explanation will be made about the base member 20F of the present embodiment. The explanation described below is applicable to each of the base members 20S and 20T.

Figure 5:
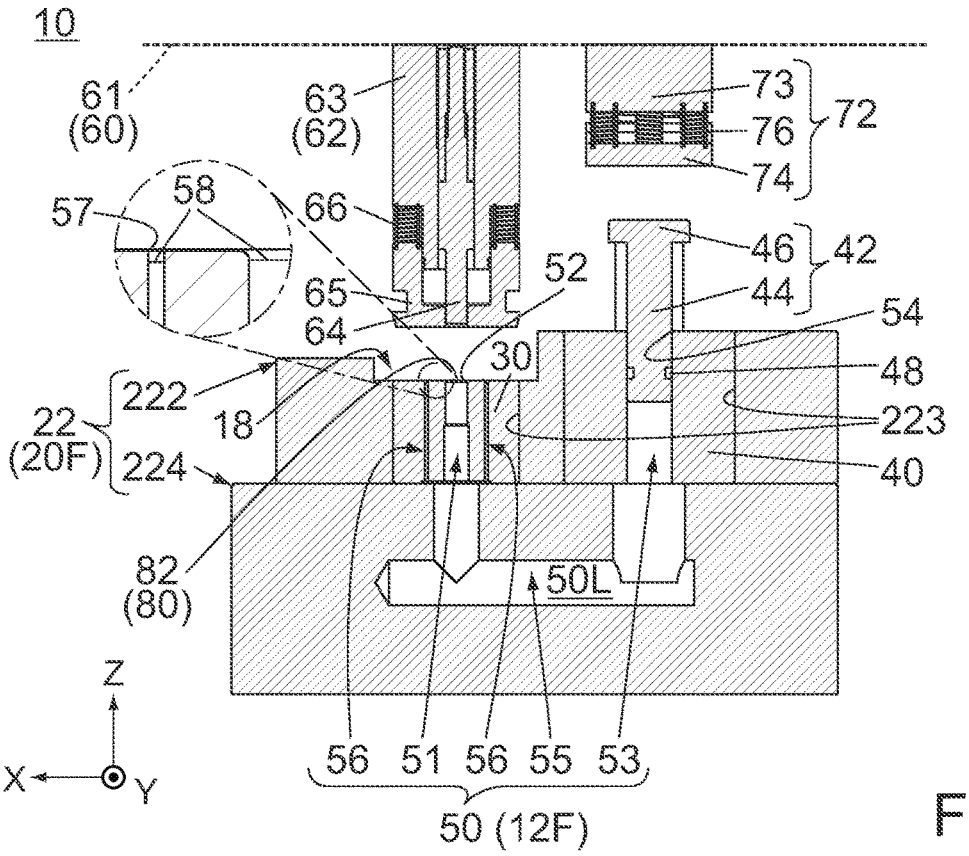
FIG. 5 is a cross-sectional view showing the workpiece processing apparatus of FIG. 4, taken along line V-V, wherein the slider is located at an upper position, a position of a lower end of the slider is illustrated with dashed line, and a part of the workpiece processing apparatus enclosed by chain dotted lines is enlarged and illustrated.

Referring to FIG. 5 together with FIG. 1, the base member 20F of the present embodiment comprises a bed 22, a die 30 made of metal and a cylinder 40 made of metal. The bed 22 comprises an upper member 222 made of metal and a lower member 224 made of metal. The upper member 222 is placed on the lower member 224. The upper member 222 is formed with the aforementioned channel 18. The base member 20F is formed with a hydraulic chamber 50. The hydraulic chamber 50 is an inner space located in the base member 20F and is closed in the base member 20F except for some openings described later. The hydraulic chamber 50 is fillable with the liquid 50L such as oil. The illustrated hydraulic chamber 50 is filled with the liquid 50L.

Referring to FIG. 5, the base member 20F of the present embodiment is formed of the upper member 222, the lower member 224, the die 30 and the cylinder combined together. According to this structure, the hydraulic chamber 50 can be easily formed. However, the present invention is not limited thereto. For example, the upper member 222, the die 30 and the cylinder 40 may be formed integrally with each other. The base member 20F may further comprise another member in addition to the aforementioned members.

Each of the die 30 and the cylinder 40 of the present embodiment has a cylindrical shape extending in the upper-lower direction. Each of the die 30 and the cylinder 40 is formed with a center hole which has a cylindrical shape extending in the upper-lower direction. The upper member 222 is formed with two attachment holes 223 each having a cylindrical shape. The die 30 and the cylinder 40 are ft into the two attachment holes 223, respectively. These cylindrical members can be easily fit into the cylindrical holes while eliminating gaps through which the liquid 50L might leak. However, the present invention is not limited thereto. The shapes of the die 30 and the cylinder 40 are not specifically limited, provided that each of the die 30 and the cylinder 40 is formed with the center hole.

Figure 11:
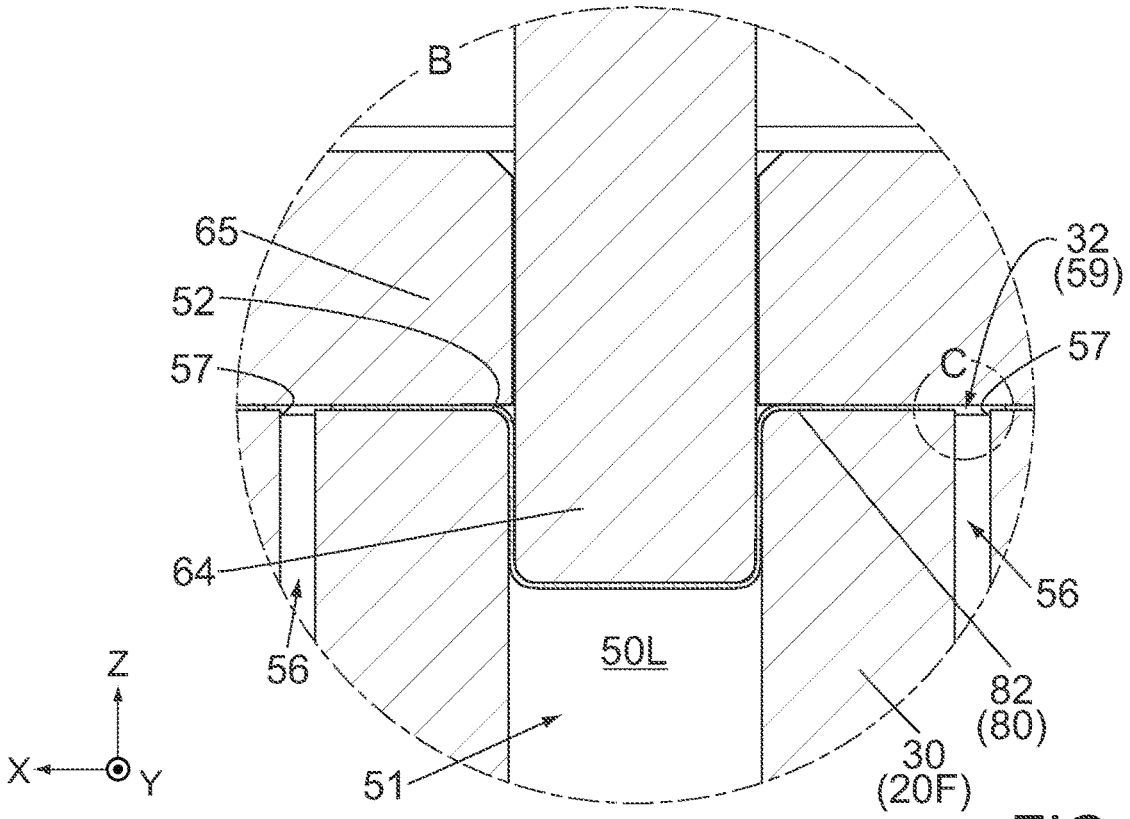
FIG. 11 is an enlarged, cross-sectional view showing a part of the workpiece processing apparatus enclosed by chain dotted lines B of FIG. 10.

The die 30 and the cylinder 40 have upper end surfaces which are exposed upward from the upper member 222. The die 30 is located forward of the cylinder 40 in a front-rear direction perpendicular to both the upper-lower direction and the lateral direction. The front-rear direction of the present embodiment is the X-direction. In the present embodiment, "forward" means the positive X-direction, and "rearward" means the negative X-direction. The upper end surface of the die 30 forms a part of the bottom surface of the channel 18. Referring to FIGS. 1 and 11, the upper end surface of the die 30 is formed with a recess 32. The recess 32 is a space which is recessed downward. The recess 32 has a ring shape in the XY-plane and encloses the center hole of the die 30.

As shown in FIG. 5, the hydraulic chamber 50 has a workpiece processing chamber 51 and a hydraulic-pressure generation chamber 53. The workpiece processing chamber 51 and the hydraulic-pressure generation chamber 53 are coupled together and have an opening 52 and an opening 54, respectively. The openings 52 and 54 open outward from the base member 20F at positions different from each other.

In detail, each of the workpiece processing chamber 51 and the hydraulic-pressure generation chamber 53 extends in the upper-lower direction and opens upward. In other words, the workpiece processing chamber 51 and the hydraulic-pressure generation chamber 53 extend in parallel to each other along the upper-lower direction and have the openings 52 and 54 each opening upward, respectively. The openings 52 and 54 of the present embodiment open at positions which are located on an upper end surface of the base member 20F but are different from each other. The hydraulic chamber 50 of the present embodiment has a coupling chamber 55 in addition to the workpiece processing chamber 51 and the hydraulic-pressure generation chamber 53. The coupling chamber 55 extends along the front-rear direction and couples a lower end of the workpiece processing chamber 51 and a lower end of the hydraulic-pressure generation chamber 53 together.

The workpiece processing chamber 51 and the hydraulic-pressure generation chamber 53 have the aforementioned structures. However, the present invention is not limited thereto, but the structures of the workpiece processing chamber 51 and the hydraulic-pressure generation chamber 53 can be variously modified.

Figure 4:
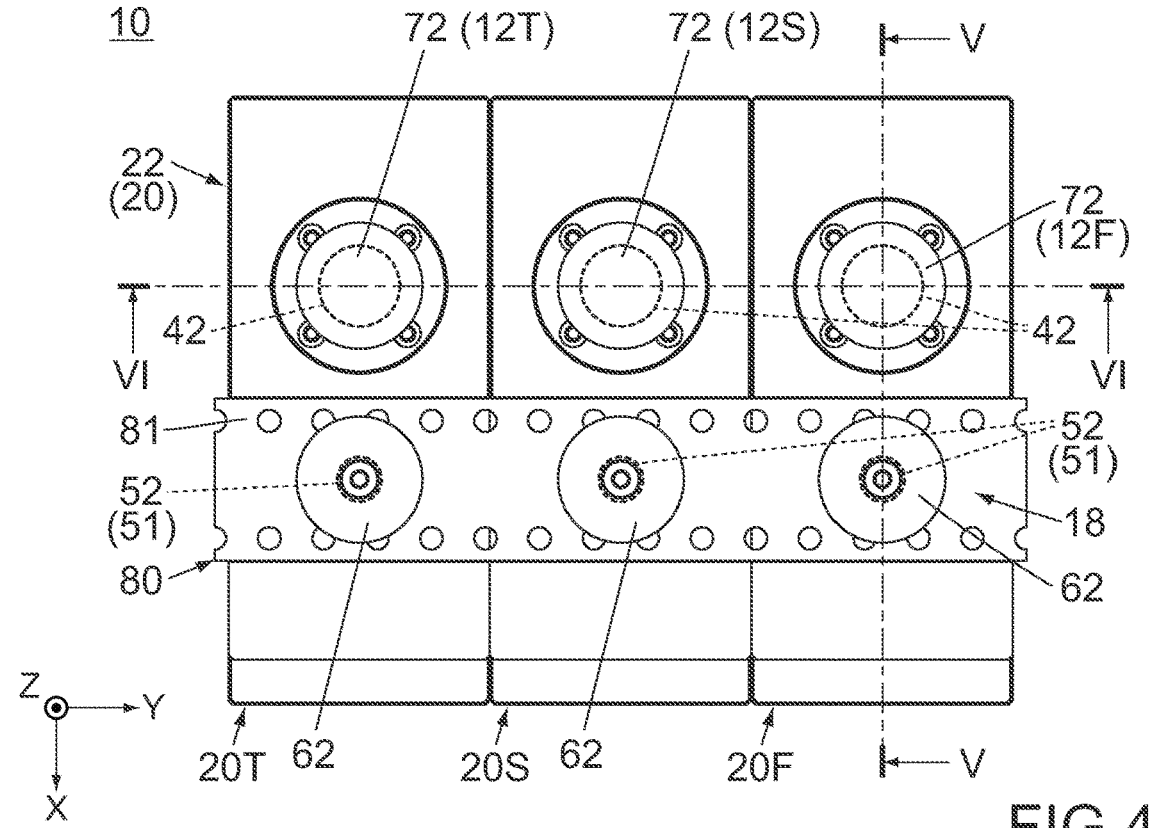
FIG. 4 is a plan view showing the workpiece processing apparatus of FIG. 1, wherein the slider is not illustrated, and positions of openings of hidden workpiece processing chambers and positions of hidden pistons are illustrated with dashed line.
Figure 13:
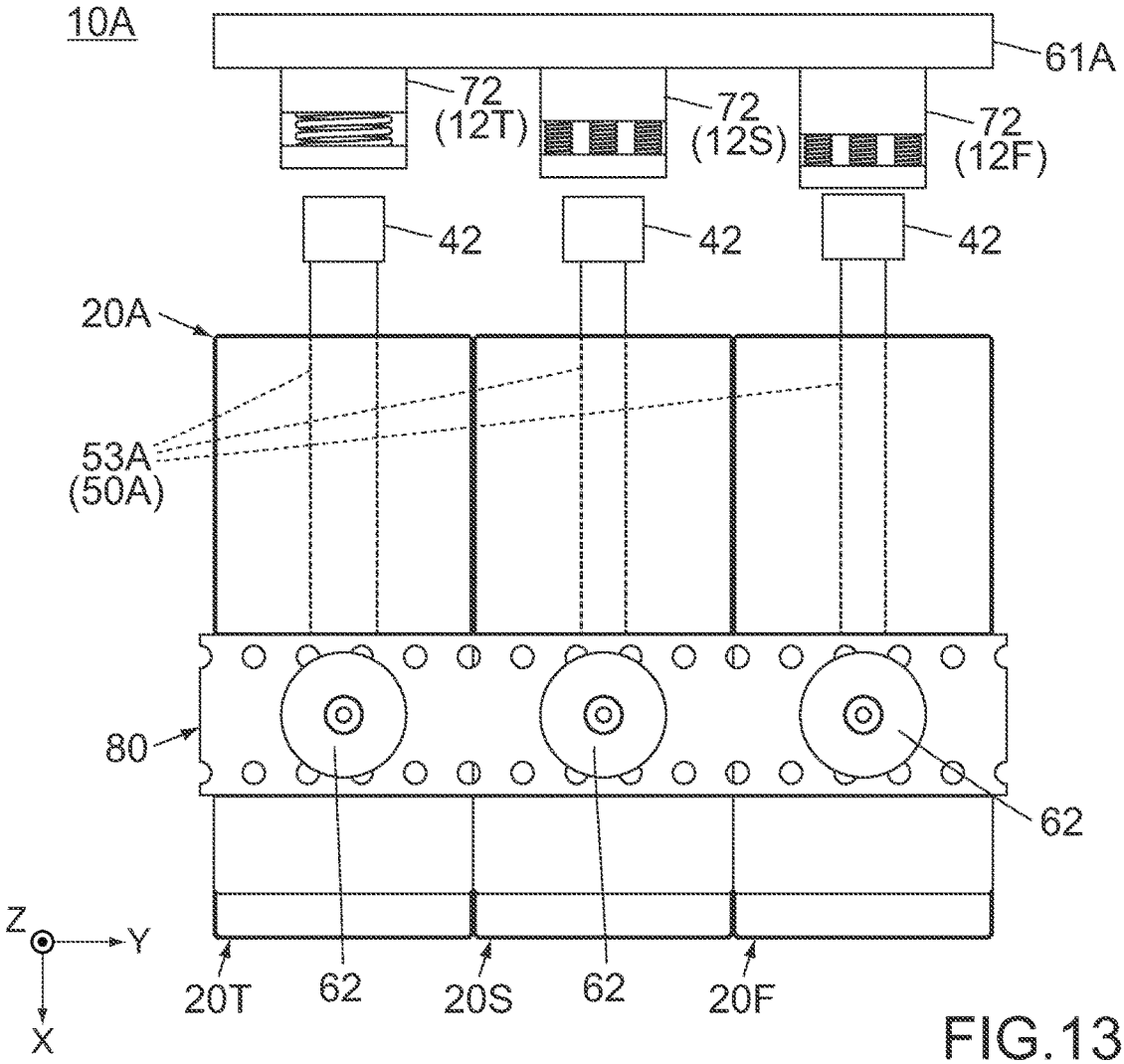
FIG. 13 is a plan view showing a modification of the workpiece processing apparatus of FIG. 1, wherein positions of hidden hydraulic-pressure generation chambers are illustrated with dashed line.

For example, comparing FIG. 13 with FIG. 4, a workpiece processing apparatus 10A according to a modification comprises a base member 20A different from the base member 20 of the present embodiment. Comparing FIG. 14 with FIG. 5, the base member 20F of the base member 20A of the present modification is formed with a hydraulic chamber 50A different from the hydraulic chamber 50. The hydraulic chamber 50A has the workpiece processing chamber 51 same as that of the hydraulic chamber 50 but has a hydraulic-pressure generation chamber 53A different from the hydraulic-pressure generation chamber 53. The hydraulic-pressure generation chamber 53A extends along the front-rear direction and opens rearward. Thus, the openings 52 and 54 of the present modification open outward from the base member at different surfaces of the base member 20F. The lower end of the workpiece processing chamber 51 and a front end of the hydraulic-pressure generation chamber 53A are coupled together with none of the coupling chamber 55 formed therebetween. According to the present modification, the coupling chamber 55 does not need to be provided.

The workpiece processing chamber 51 of the present embodiment extends through the center hole of the die 30. The opening 52 of the workpiece processing chamber 51 is located at the upper end surface of the die 30. The hydraulic-pressure generation chamber 53 of the present embodiment extends through the center hole of the cylinder 40. The opening 54 of the hydraulic-pressure generation chamber 53 is located at the upper end surface of the cylinder 40 and is located above the opening 52. Each of the workpiece processing chamber 51 and the hydraulic-pressure generation chamber 53 has a circular shape in the XY-plane. The coupling chamber has a circular shape in a perpendicular plane (YZ-plane) perpendicular to the front-rear direction.

Figure 10:
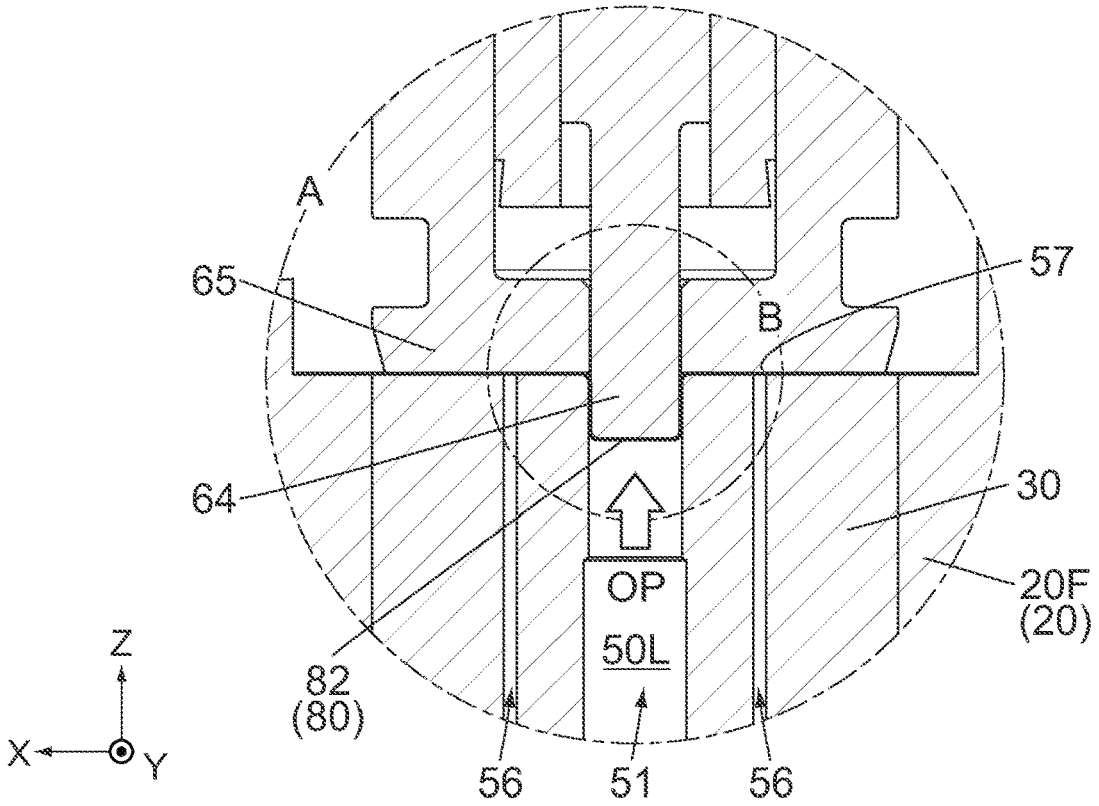
FIG. 10 is an enlarged, cross-sectional view showing a part of the workpiece processing apparatus enclosed by chain dotted lines A of FIG. 9.

Referring to FIGS. 5 and 10 together with FIG. 1, the hydraulic chamber 50 of the present embodiment further has four branch channels 56. The four branch channels 56 are located forward of the workpiece processing chamber 51, rearward of the workpiece processing chamber 51 and at opposite sides of the workpiece processing chamber 51 in the lateral direction, respectively. Each of the branch channels 56 branches off from the workpiece processing chamber 51. In detail, a part of a lower end surface of the die 30 is located slightly above an upper end surface of the lower member 224, and this arrangement forms a flow channel which extends outward from the workpiece processing chamber 51 in the XY-plane. Each of the branch channels 56 extend upward from this flow channel.

Each of the branch channels 56 extends in parallel to the workpiece processing chamber 51 along the upper-lower direction through a small hole formed in the die 30 and opens upward. Each of the thus-formed branch channels 56 has an opening 57 which opens outward from the base member 20F. Referring to FIG. 11, each of the openings 57 is located at a bottom surface of the recess 32 of the die 30. Each of the thus-formed openings 57 is located slightly below the opening 52 of the workpiece processing chamber 51.

Referring to FIG. 5, the hydraulic chamber 50 of the present embodiment has the aforementioned structure. However, the present invention is not limited thereto, but the structure of the hydraulic chamber 50 can be modified as necessary. For example, the coupling chamber 55 and the branch channels 56 may be provided as necessary. Instead, the hydraulic chamber 50 may further have another portion in addition to the aforementioned portions.

Figure 6:
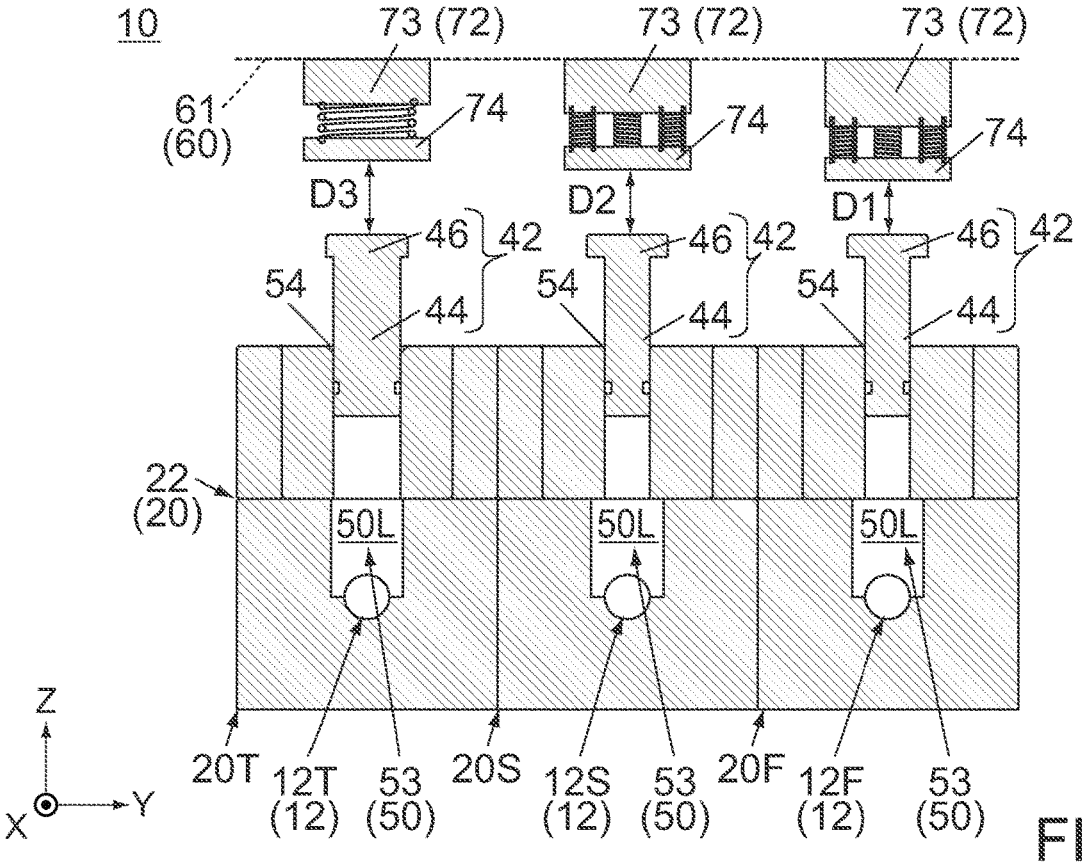
FIG. 6 is a cross-sectional view showing the workpiece processing apparatus of FIG. 4, taken along line VI-VI, wherein the slider is located at the upper position, and a position of the lower end of the slider is illustrated with dashed line.

Referring to FIG. 6, the three pistons 42 of the present embodiment are provided so that they correspond to the three hydraulic chambers 50, respectively. Hereafter, explanation will be made about the piston 42 which corresponds to the hydraulic chamber 50 of the base member 20F. The explanation described below is applicable to each of the pistons 42.

As shown in FIGS. 1 and 5, the piston 42 of the present embodiment has a body 44 and a pressed portion 46. Each of the body 44 and the pressed portion 46 has a cylindrical shape extending along the upper-lower direction. The pressed portion 46 has a size in the XY-plane which is larger than another size of the body 44 in the XY-plane. The body 44 extends downward from a lower end of the pressed portion 46.

Referring to FIG. 5, the piston 42 is partially received in the hydraulic-pressure generation chamber 53 through the opening 54 of the hydraulic-pressure generation chamber 53 so that the piston 42 is movable in the hydraulic-pressure generation chamber 53. The piston 42 partially projects from the hydraulic-pressure generation chamber 53. According to the present embodiment, the body 44 of the piston 42 is inserted into the hydraulic-pressure generation chamber 53 while passing downward through the opening 54. The thus-inserted body 44 is movable in the upper-lower direction. Thus, the piston 42 of the present embodiment is partially received in the hydraulic-pressure generation chamber 53 so that the piston 42 is movable in the upper-lower direction and projects upward from the hydraulic-pressure generation chamber 53.

A lower part of the body 44 of the present embodiment is received in the center hole formed in the cylinder 40 substantially with no gap left therebetween. On the other hand, an upper part of the body 44 projects upward from the hydraulic-pressure generation chamber 53. The lower end of the body 44 is in contact with the liquid 50L. An O-ring 48 is attached to the lower part of the body 44 so that leakage of the liquid 50L is prevented.

The piston 42 of the present embodiment has the aforementioned structure and is attached to the base member 20F as described above. However, the present invention is not limited thereto. For example, the O-ring 48 may be provided as necessary. Moreover, referring to the modification shown in FIG. 14, the piston 42 according to the modification is inserted into the hydraulic-pressure generation chamber 53 while passing forward through the opening 54 which opens rearward. The piston 42 projects rearward from the hydraulic-pressure generation chamber 53. The piston 42 is movable along the front-rear direction in the hydraulic-pressure generation chamber 53.

Referring to FIG. 1, hereafter, explanation will be made about the movable member 60 of the present embodiment.

The movable member 60 of the present embodiment comprises a slider 61, three workpiece processing members 62 and three spacers 72. Thus, the workpiece processing apparatus 10 of the present embodiment comprises the slider 61, the workpiece processing members 62 and the spacers 72.

Referring to FIGS. 1 to 3, the slider 61 of the present embodiment is located above the base member 20 in the upper-lower direction. The slider 61 is supported by a power device (not shown) and is movable in the upper-lower direction between an upper position shown in FIGS. 1 to 3 at which the object 80 is not processed and a lower position shown in FIG. 9 at which the object 80 is processed. The slider 61 of the present embodiment has a flat-plate shape extending along the XY-plane. However, the shape and the inner structure of the slider 61 of the present invention are not specifically limited.

Referring to FIG. 4, the three workpiece processing members 62 are provided so that they correspond to the three base members 20F, 20S and 20T, respectively. The workpiece processing members 62 are located at positions which correspond to those of the openings 52 of the workpiece processing chambers 51 in the XY-plane, respectively. As can be seen from this arrangement, the number of the workpiece processing members 62 may correspond to the number of the members which process the workpieces 82 (see FIG. 1) of the object 80. For example, when the workpiece processing apparatus 10 comprises only the base member 20F, the number of the workpiece processing member 62 may be one.

Referring to FIGS. 2 and 5, each of the workpiece processing members 62 of the present embodiment comprises a base 63 made of metal, a punch 64 made of metal, a holder 65 made of metal and a holder-support member 66 formed of one or more metal springs. Thus, the workpiece processing apparatus 10 of the present embodiment comprises the bases 63, the punches 64, the holders 65 and the holder-support members 66. Each of the punches 64 has a circular shape in the XY-plane. Each of the bases 63 and the holders 65 has a circular ring shape in the XY-plane. Each of the workpiece processing members 62 of the present embodiment comprises the aforementioned members. However, the present invention is not limited thereto. For example, the shape of each member of each of the workpiece processing members 62 is not specifically limited.

Referring to FIG. 4, the three spacers 72 are provided so that they correspond to the three pistons 42, respectively. The spacers 72 are located at positions which correspond to those of the pistons 42 in the XY-plane, respectively. As can be seen from this arrangement, the number of the spacers 72 may correspond to the number of the pistons 42. For example, when the workpiece processing apparatus 10 comprises only one of the pistons 42 attached to the base member 20F, the number of the spacers 72 may be one.

Referring to FIGS. 3 and 5, each of the spacers 72 of the present embodiment comprises a base 73 made of metal, a pressing portion 74 made of metal and a support member (resilient member) 76 formed of one or more metal springs. Thus, the workpiece processing apparatus 10 of the present embodiment comprises the bases 73, the pressing portions 74 and the resilient members 76. Each of the bases 73 and the pressing portions 74 has a cylindrical shape extending along the upper-lower direction. Each of the spacers 72 of the present embodiment comprises the aforementioned members. However, the present invention is not limited thereto. For example, the shape of each member of each of the spacers 72 is not specifically limited.

Referring to FIG. 5 together with FIGS. 2 and 3, the movable member 60 of the present embodiment comprises the aforementioned members. The punches 64, holders 65 and the spacers 72 are fixed to the slider 61 and are movable together with the slider 61. However, the present invention is not limited thereto. For example, the slider 61, the holders 65, the holder-support members 66 and the spacers 72 may be provided as necessary. For example, When the base member 20 comprises only the base member 20F, the movable member 60 may comprise only one of the punches 64 corresponding to the base member 20F. Instead, the movable member 60 may further comprise another member in addition to the aforementioned members.

Referring to FIG. 2 together with FIG. 1, the three punches 64, the three holders 65 and the three spacers 72 of the present embodiment process the three workpieces 82 of the object 80, respectively, in cooperation with the three base members 20F, 20S and 20T, respectively. In other words, referring to FIG. 3, the workpiece processing apparatus 10 of the present embodiment comprises three workpiece processing sets 12 configured to process the workpieces 82 (see FIG. 1), respectively. In detail, the workpiece processing apparatus 10 of the present embodiment comprises the three workpiece processing sets 12 consisting of a first set (workpiece processing set) 12F, a second set (workpiece processing set) 12S and a third set (workpiece processing set) 12T. However, the present invention is not limited thereto, but the number of the workpiece processing sets 12 may be one, two or more than three. For example, the workpiece processing apparatus 10 may comprise only the one workpiece processing set 12F or may comprise two or more of the workpiece processing sets 12.

Hereafter, explanation will be made about the workpiece processing sets 12 of the present embodiment.

Referring to FIG. 6 together with FIG. 2, each of the workpiece processing sets 12 of the present embodiment includes the hydraulic chamber 50, the piston 42, the punch 64, the holder 65 and the spacer 72. However, the present invention is not limited thereto. For example, the workpiece processing apparatus 10 may comprise none of the holders 65 and none of the spacers 72. In this instance, each of the workpiece processing sets 12 should comprise the hydraulic chamber 50, the piston 42 and the punch 64.

Referring to FIG. 6, each of the pistons 42 of the present embodiment has the previously described body 44. Each of the bodies 44 is partially received in the hydraulic-pressure generation chamber 53 and the lower end thereof is in contact with the liquid 50L.

Referring to FIG. 5 together with FIG. 2, each of the punches 64 of the present embodiment is fixed to the slider 61 by a fixing member such as a screw and extends downward from a lower end surface of the slider 61. Each of the bases 63 of the present embodiment is fixed to the slider 61 by a fixing member such as a screw. Each of the bases 63 extends downward from the lower end surface of the slider 61 while enclosing the punch 64 in the XY-plane.

Each of the holder-support members 66 of the present embodiment is attached to an outer circumference of the base 63 in the XY-plane and extends along the upper-lower direction. Each of the holders 65 of the present embodiment is located outward of the punch 64 in the XY-plane. In other words, each of the holders enclosed the punch 64 in the XY-plane. Each of the holders 65 is attached to a lower end of the holder-support member 66. Each of the holder-support members 66 has resiliency and support the holder 65 so that the holder 65 is movable relative to the slider 61. According to the present embodiment, a lower end of each of the punches 64 is located slightly above a lower end of the holder 65.

Referring to FIG. 5 together with FIG. 3, the base 73 of each of the spacers 72 of the present embodiment is fixed to the slider 61 by a fixing member such as a screw and extends downward from the lower end surface of the slider 61. Each of the pressing portions 74 is configured to press the piston 42 downward. Each of the resilient members 76 is formed of one or more metal springs and has resiliency. In each of the spacers 72, an upper end of each of the metal springs is attached to the base 73, and a lower end of each of the metal springs is attached to the pressing portion 74. According to this structure, each of the resilient members 76 supports the pressing portion 74 so that the pressing portion 74 is movable relative to the slider 61. However, the present invention is not limited thereto. For example, each of the spacers 72 may comprise only the resilient member 76. In this instance, a lower end of each of the resilient members 76 works as the pressing portion 74.

Each of the pressing portions 74 of the present embodiment is movable in the upper-lower direction. However, the present invention is not limited thereto. For example, referring to the modification shown in FIG. 14, each of the pressing portions 74 of the modification is movable in the front-rear direction.

Referring to FIGS. 2 and 3, all the punches 64 and all the spacers 72 of the present embodiment are directly fixed to the single slider 61 and project downward from the single slider 61. All the holders 65 of the present embodiment are indirectly fixed to the single slider 61 via the holder-support members 66 each having resiliency and project downward from the single slider 61. Therefore, by merely moving the single slider 61 in the upper-lower direction, all the punches 64, all the holders 65 and all the spacers 72 are moved in the upper-lower direction.

Each of the workpiece processing sets 12 of the present embodiment has the aforementioned structure. According to this structure, all the punches 64, all the holders 65 and all the spacers 72 can be simultaneously moved by the common slider 61 attached to one power device (not shown), and thereby the workpiece processing apparatus 10 can be reduced in size. However, the present invention is not limited thereto. For example, each of the punches 64, the holders 65 and the spacers 72 may be fixed to one of power devices (not shown) which work independently from each other so that each of the punches 64, the holders 65 and the spacers 72 can be moved in the upper-lower direction. Moreover, the structure for supporting the holder 65 is not specifically limited. The holder-support member 66 is not limited to the metal springs, provided that the holder-support member 66 has resiliency. Similarly, each of the resilient members 76 is not limited to the metal springs.

Hereafter, explanation will be made about the processing steps performed by the first set 12F which is one of the workpiece processing sets 12 of the present embodiment. The explanation described below is applicable to each of the second set 12S and the third set 12T.

Figure 9:
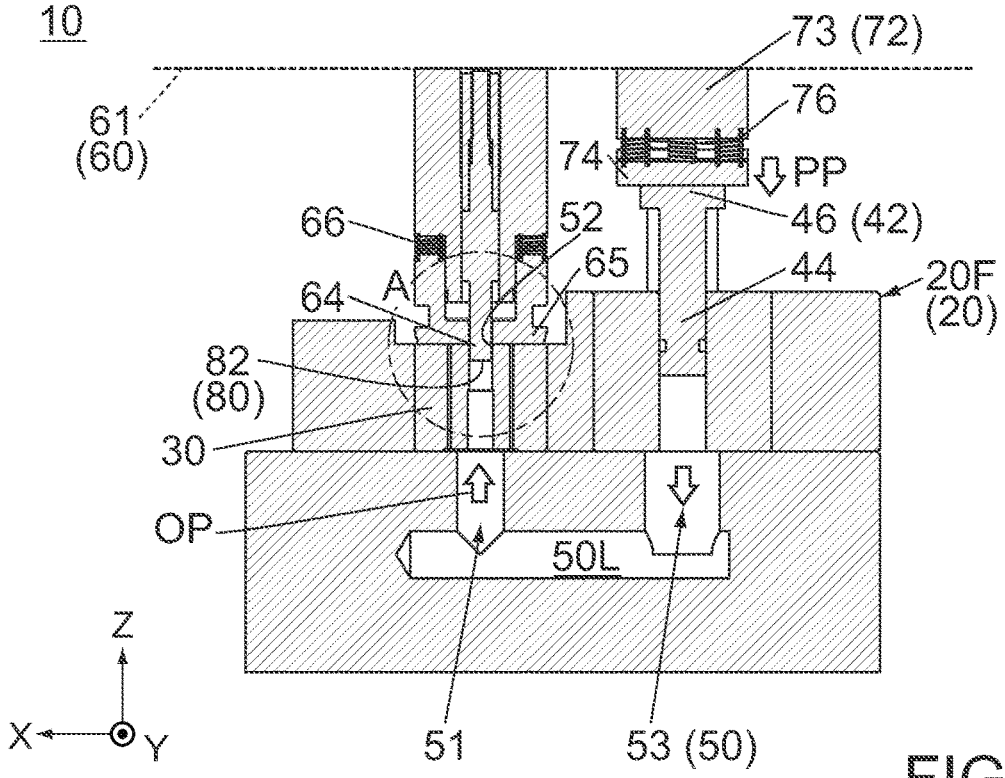
FIG. 9 is another cross-sectional view showing the workpiece processing apparatus of FIG. 8, wherein the slider is further moved downward and is located at a lower position.

Referring to FIGS. 5 and 9, the punch 64 is movable between an initial position which is apart from the opening 52 of the workpiece processing chamber 51 as shown in FIG. 5 and a received position at which the punch 64 is partially received in the workpiece processing chamber 51 through the opening 52 of the workpiece processing chamber 51 as shown in FIG. 9. The initial position of the present embodiment is located above the received position. The punch 64 of the present embodiment is moved in the upper-lower direction between the initial position and the received position in accordance with the movement of the slider 61 in the upper-lower direction between the upper position shown in FIG. 5 and the lower position shown in FIG. 9. However, the present invention is not limited thereto. For example, the punch 64 may directly receive a force from a power device (not shown) to be moved in the upper-lower direction between the initial position and the received position.

Figure 7:
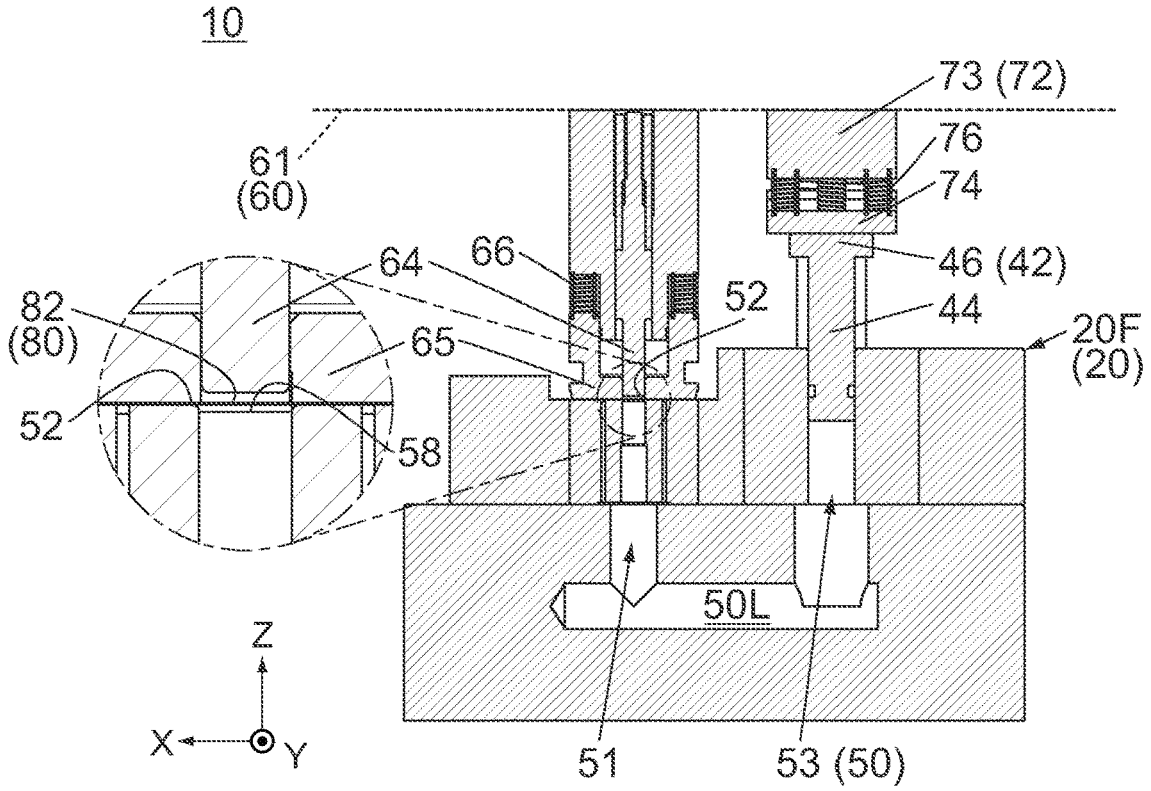
FIG. 7 is another cross-sectional view showing the workpiece processing apparatus of FIG. 5, wherein the slider is moved downward, a lower end of the spacer is in contact with the piston, a lower end of a holder is in contact with the object, and a part of the workpiece processing apparatus enclosed by chain dotted lines is enlarged and illustrated.

Referring to FIGS. 5 and 7, the spacer 72 of the present embodiment is moved in the upper-lower direction together with the punch 64 in accordance with the movement of the slider 61 in the upper-lower direction. When the punch 64 is moved from the initial position shown in FIG. 5 to a middle position shown in FIG. 7, the pressing portion 74 of the spacer 72 is brought into contact with the pressed portion 46 of the piston 42. Referring to FIG. 7, when the pressing portion 74 is brought into contact with the pressed portion 46, the punch 64 is located above the opening 52 of the workpiece processing chamber 51. At that time, the liquid surface 58 of the liquid 50L is located under the opening 52. Thus, the liquid 50L is kept in the hydraulic chamber 50.

According to the present embodiment, the lower end of the holder 65 is brought into contact with the object 80 at the same time when the spacer 72 is brought into contact with the piston 42. However, the present invention is not limited thereto. For example, the lower end of the holder 65 may be brought into contact with the object 80 before the spacer 72 is brought into contact with the piston 42.

Figure 8:
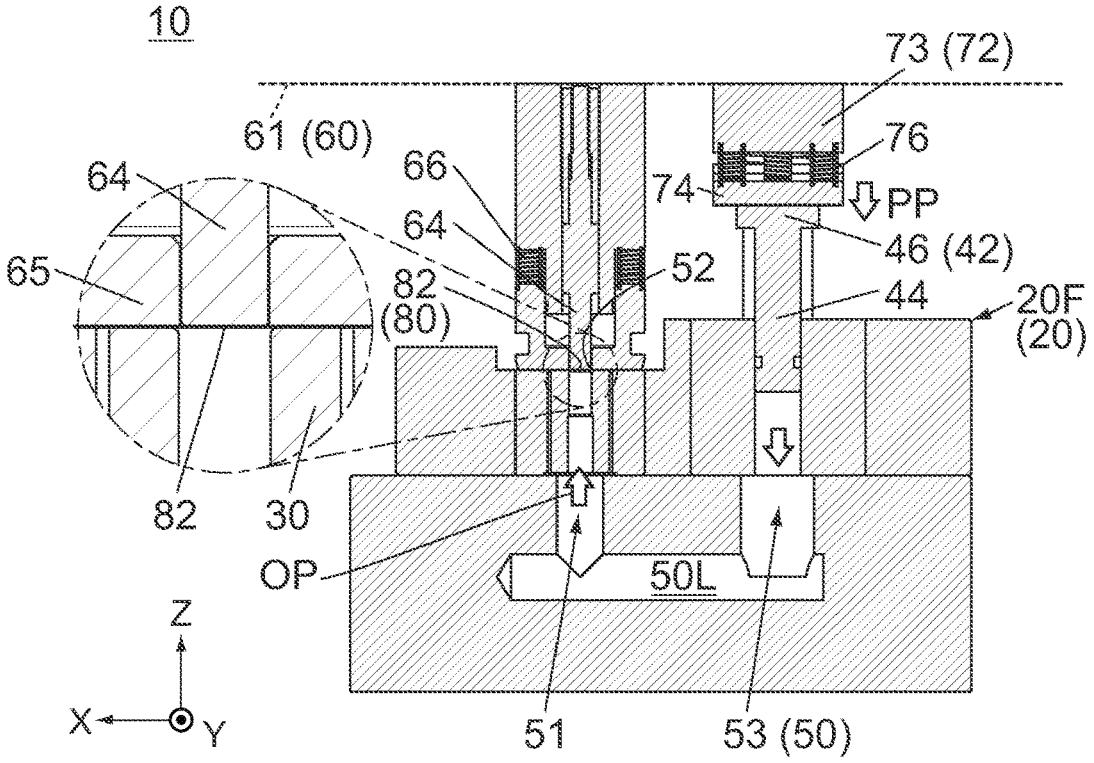
FIG. 8 is another cross-sectional view showing the workpiece processing apparatus of FIG. 7, wherein the slider is further moved downward, the spacer presses the piston, a lower end of the punch is in contact with the object, and a part of the workpiece processing apparatus enclosed by chain dotted lines is enlarged and illustrated.

Referring to FIGS. 7 to 9, when the punch 64 is continuously moved from the middle position shown in FIG. 7 toward the received position shown in FIG. 9, the punch 64 is moved to a processing start position shown in FIG. 8. During a movement of the punch 64 from the middle position to the processing start position, the holder-support member 66 presses the holder 65 against the object 80 while being resiliently compressed. As a result, the punch 64 is moved downward relative to the holder 65. When the punch 64 is moved to the processing start position, the lower end of the punch 64 is located at a position same as that of the lower end of the holder 65 and is brought into contact with the workpiece 82 of the object 80.

Figure 12:
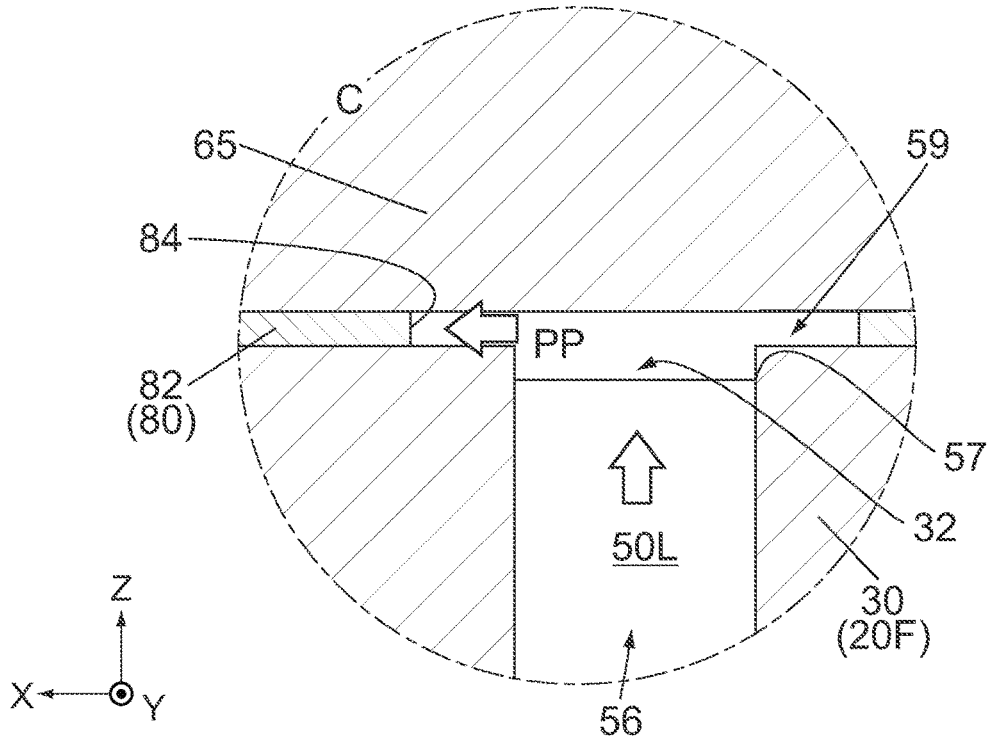
FIG. 12 is an enlarged, cross-sectional view showing a part of the workpiece processing apparatus enclosed by chain dotted lines C of FIG. 11.

Referring to FIG. 8 together with FIGS. 11 and 12, when the punch 64 is moved to the processing start position shown in FIG. 8, the holder 65 applies a force due to a restoring force of the holder-support member 66 to an outer circumference of the workpiece 82 in the XY-plane. The holder 65 presses the outer circumference of the workpiece 82 in the XY-plane against the upper end surface of the die 30 of the base member 20F. The workpiece 82 pressed against the base member 20F forms a closed space 59 including the recess 32 together with the holder 65 and the base member 20F.

Referring to FIGS. 7 and 8, during the movement of the punch 64 from the middle position shown in FIG. 7 to the processing start position shown in FIG. 8, the resilient member 76 of the spacer 72 presses the pressing portion 74 against the piston 42 while being resiliently compressed. As a result, the piston 42 is pushed into the hydraulic-pressure generation chamber 53. The thus pushed piston 42 is moved into the hydraulic-pressure generation chamber 53. As a result, the liquid surface 58 of the liquid 50L rises, and the liquid 50L is brought into contact with a lower surface of the workpiece 82 of the object 80 and fills the inside of the closed space 59 (see FIG. 12). The liquid 50L is shut in the closed space 59 with no leakage toward the outside of the closed space 59.

Referring to FIGS. 5, 8 and 9, when the punch 64 is moved from the initial position shown in FIG. 5 to the received position show in FIG. 9 under a state where the opening 52 of the workpiece processing chamber 51 is covered by the workpiece 82 of the object 80, the punch 64 presses the workpiece 82 into the workpiece processing chamber 51. In detail, during a movement of the punch 64 from the processing start position shown in FIG. 8 to the received position, the punch 64 presses the workpiece 82 into the workpiece processing chamber 51. As a result, the workpiece 82 is partially received into the workpiece processing chamber 51 while being deformed and pushing down the liquid surfaces 58 of the opening 52.

During the movement of the punch 64 from the processing start position shown in FIG. 8 to the received position shown in FIG. 9, the pressing portion 74 of the spacer 72 continuously applies a pressing force PP to the piston 42 via the resilient member 76. As a result, an active hydraulic counterpressure OP (hereafter, simply referred to as "hydraulic counterpressure OP") of about 30 to 60 MPa is generated, for example. As described above, when the hydraulic chamber 50 is filled with the liquid the piston 42 receives the pressing force PP directed into the hydraulic-pressure generation chamber 53 via the resilient member 76 in a course of movement of the punch 64 from the initial position shown in FIG. 5 to the received position, and the piston 42 is moved in accordance with the pressing force PP and increases hydraulic pressure of the liquid 50L. The punch 64 continuously presses the workpiece 82 against this hydraulic counterpressure OP, and thereby the workpiece 82 is drawn.

The hydraulic pressure generated according to the present embodiment is adjustable by the spring force of the resilient member 76, more specifically, by elastic modulus of the metal spring. Accordingly, the hydraulic pressure can be prevented from being excessively high. Thus, the resilient member 76 works as a hydraulic pressure adjustment mechanism.

Summarizing the explanation described above, the piston 42 of the present embodiment is moved in accordance with the pressing force PP applied via the resilient member 76 and increases the hydraulic pressure of the liquid 50L in the hydraulic chamber 50. According to this structure, when the hydraulic pressure in the hydraulic chamber 50 exceeds a predetermined value, the piston 42 cannot be moved into the hydraulic-pressure generation chamber 53. Thus, the hydraulic pressure can be prevented from being excessively increased by using the resiliency of the resilient member 76 without providing a relief valve. In addition, since the liquid 50L is kept in the hydraulic chamber 50 because of the structure in which no relief valve is provided, the liquid 50L does not need to be supplied from the outside. Therefore, there is no need to provide a complex hydraulic-pressure control mechanism including a pump and a relief valve. The present embodiment provides the new workpiece processing apparatus 10 which is configured to use hydraulic pressure to process the workpiece 82 of the object 80 and has a simpler structure.

The workpiece processing apparatus 10 of the present embodiment is particularly suitable to process a small member such as a shell (not shown) of a connector (not shown) configured to be incorporated in an electronic device (not shown). For example, the workpiece processing apparatus 10 can shape the workpiece 82 having a size about several mm into a desired shape. However, the present invention is not limited thereto. For example, the size of the object 80 is not specifically limited.

Referring to FIGS. 5, 8 and 9, according to the present embodiment, when the slider 61 is moved from the upper position shown in FIG. 5 toward the lower position shown in FIG. 9 under a state where the hydraulic chamber 50 is filled with the liquid and the workpiece 82 of the object 80 is placed on the workpiece processing chamber 51 as shown in FIG. 5, the punch 64 is moved downward and presses the workpiece 82 into the workpiece processing chamber 51, and the piston 42 is moved downward in accordance with the pressing force PP and increases the hydraulic pressure of the liquid 50L. The piston 42 of the present embodiment receives the pressing force PP directed downward from the slider 61 via the resilient member 76 in a course of movement of the slider 61 from the upper position to the lower position. However, the present invention is not limited thereto.

Figure 14:
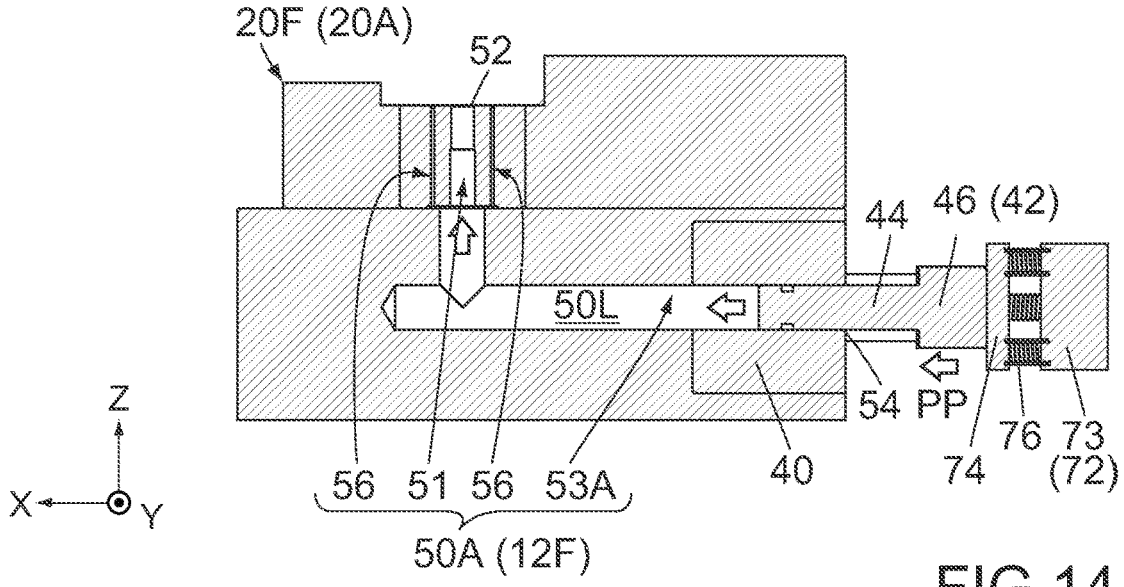
FIG. 14 is a cross-sectional view showing a base member, a piston and a spacer of the workpiece processing apparatus of FIG. 13, wherein the illustrated cross-section corresponds to the cross-section of FIG. 5.
Figure 15:
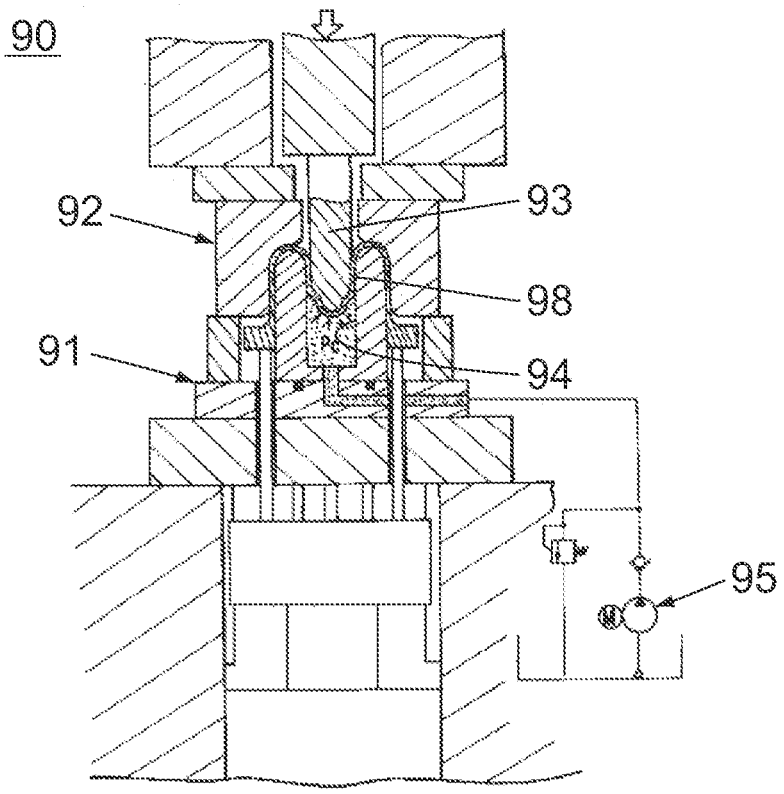
FIG.15 PRIOR ART
FIG. 15 is a cross-sectional view showing a workpiece processing apparatus of Patent Document 1.

For example, referring to the modification shown in FIGS. 13 and 14, the workpiece processing apparatus 10A according to the modification comprises an additional slider 61A in addition to the slider 61. The additional slider 61A is moved in the front-rear direction in cooperation with the movement of the slider 61 in the upper-lower direction. The piston 42 of the present modification receives a pressing force PP directed forward from the additional slider 61A via the resilient member 76 in accordance with the forward movement of the additional slider 61A. The piston 42 of the present modification is also moved in accordance with the pressing force PP applied via the resilient member 76 and increases the hydraulic pressure of the liquid in the hydraulic chamber 50A.

Referring to FIG. 5, according to the present embodiment, when the slider 61 is located at the upper position shown in FIG. 5, a first distance, or a distance between the lower end of the punch 64 and the workpiece 82 of the object 80 in the upper-lower direction, is longer than a second distance, or another distance between the lower end of the spacer 72 and an upper end of the piston 42 in the upper-lower direction. Referring to FIGS. 5 and 8, according to this arrangement, the piston 42 receives the pressing force PP before the punch 64 starts to process the workpiece 82. However, the present invention is not limited thereto. For example, the first distance may be shorter than the second distance. In this instance, the piston 42 receives the pressing force PP and generates the hydraulic counterpressure OP after the processing of the workpiece 82 by the punch 64 starts.

Referring to FIG. 8, the piston 42 of the present embodiment receives the pressing force PP from the slider 61 via the spacer 72. However, the present invention is not limited thereto. For example, when the spacer 72 is not provided, the slider 61 may have resilient portion having resiliency. The piston 42 may receive the pressing force PP from the resilient portion of the slider 61.

Referring to FIGS. 5, 7 and 8, according to the present embodiment, when the slider 61 is moved downward under a state where the workpiece 82 is placed on the workpiece processing chamber 51, the holder 65 is moved downward and presses the workpiece 82 against the base member 20F. According to this mechanism, the workpiece 82 can be drawn while the workpiece 82 is not formed with wrinkles. According to the present embodiment, the holder 65 presses the workpiece 82 before the processing by the punch 64 starts. However, the present invention is not limited thereto. For example, the holder 65 may press the workpiece 82 after the processing by the punch 64 starts. More specifically, when the slider 61 is located at the upper position shown in FIG. 5, the punch 64 may project downward slightly beyond the lower end of the holder 65. Moreover, as previously described, the holder 65 may be provided as necessary.

Referring to FIGS. 11 and 12, the openings 57 of the branch channels 56 of the present embodiment open in the closed space 59. When the holder 65 presses the workpiece 82 against the base member 20F, the openings 57 of the branch channels 56 are located below the holder 65 in the upper-lower direction and are located outward of a peripheral edge 84 of the workpiece 82 in the XY-plane.

When the piston 42 is pressed into the hydraulic-pressure generation chamber 53, the liquid 50L fills the closed space 59 and applies the peripheral hydraulic pressure PP to the peripheral edge 84 of the workpiece 82. The workpiece 82 is pushed into the workpiece processing chamber 51 by the peripheral hydraulic pressure PP. According to this mechanism, the workpiece 82 can be easily drawn so that the workpiece 82 has a desired shape. Moreover, according to the present embodiment, the hydraulic counterpressure OP and the peripheral hydraulic pressure PP can be simultaneously generated by merely moving the single slider 61 (see FIG. 9) downward. However, the present invention is not limited thereto. The branch channels 56 may be provided as necessary as previously described.

Referring to FIG. 3, the workpiece processing apparatus 10 of the present embodiment comprises the three workpiece processing sets 12 as previously described. As described below, the workpiece processing sets 12 of the present embodiment generate the hydraulic pressures different from each other at timings different from each other.

Referring to FIG. 6, each of the pistons 42 of the three workpiece processing sets 12 receives the pressing force PP from the spacer 72 in a course of movement of the slider 61 from the upper position shown in FIG. 6 to the lower position shown in FIG. 9. When the slider 61 is located at the upper position, each of the spacers 72 is apart from the piston 42 by a predetermined distance D1, D2 or D3 in the upper-lower direction.

The predetermined distances D1, D2 and D3 of the present embodiment are different from each other. As can be seen from this distance condition, the pistons 42 of the present embodiment receive the pressing forces PP (see FIG. 8) from the spacers 72 at timings different from each other. However, the present invention is not limited thereto. For example, two of the three predetermined distances D1, D2 and D3 may be equal to each other. Thus, at least one of the predetermined distances D1, D2 and D3 may be different from a remaining one of the predetermined distances D1, D2 and D3. In other words, at least one of the pistons 42 may receive the pressing force PP from the slider 61 at a timing different from another timing at which a remaining one of the pistons 42 receives the pressing force PP.

Referring to FIG. 2, according to the present embodiment, the punches 64 of the three workpiece processing sets 12 have diameters same as each other. Referring to FIG. 6, the bodies 44 of the pistons 42 of the workpiece processing set 12F and 12S have diameters same as each other in the XY-plane, and thereby have cross-sectional areas same as each other in the XY-plane. In contrast, the body 44 of the piston 42 of the workpiece processing set 12T has a cross-sectional area different from those of the bodies 44 of the pistons 42 of the workpiece processing set 12F and 12S in the XY-plane. Thus, at least one of the bodies 44 has a cross-sectional area different from another cross-sectional area of a remaining one of the bodies 44 in the XY-plane.

According to the present embodiment, the workpiece processing sets 12F and 12S generate the hydraulic pressures same as each other, but the workpiece processing set 12T generates the hydraulic pressure different from those of the workpiece processing sets 12F and 12S. However, the present invention is not limited thereto. For example, the bodies 44 of the three workpiece processing sets 12 may have cross-sectional areas different from each other in the XY-plane. Thus, the three workpiece processing sets 12 may generate the hydraulic pressures different from each other.

According to the present embodiment, the hydraulic pressure of at least one of the workpiece processing sets 12 is different from the hydraulic pressure of a remaining one of the workpiece processing sets 12 at a predetermined timing. Referring to FIG. 9, the predetermined timing of the present embodiment is a timing when the workpiece 82 is processed.

Referring to FIG. 3, according to the present embodiment, the workpiece processing set 12F generates a relatively large hydraulic pressure at an early timing, the workpiece processing set 12S generates the same hydraulic pressure as that of the workpiece processing set 12F at a later timing, and the workpiece processing set 12T generates a relatively small hydraulic pressure at an even later timing.

Referring to FIG. 4, the workpiece processing apparatus 10 of the present embodiment comprises the three workpiece processing sets 12 as described above and can perform deep drawing to one of the workpieces 82 via the three processing steps each of which uses the hydraulic pressure. In other words, the workpiece processing apparatus 10 of the present embodiment is a deep drawing apparatus. The workpiece processing apparatus 10 can progressively process one of the workpieces 82 (see FIG. 1) by sequentially transferring the object 80 along the channel 18. For example, the workpiece processing set 12F can perform drawing, the workpiece processing set 12S can perform deeper drawing, and the workpiece processing set 12T can perform final drawing so that spring back can be prevented. Instead, different processes can be simultaneously performed to three of the workpieces 82, respectively. Moreover, another workpiece processing set 12 can be provided so that the workpiece 82 is cut off from the carrier 81 (see FIG. 1).

Explaining the structure of the workpiece processing apparatus 10 of the present embodiment from another viewpoint with reference to FIG. 1, the workpiece processing apparatus 10 comprises a main member (partial device) 11 and the slider 61. The main member 11 of the present embodiment includes all the members of the illustrated workpiece processing apparatus 10 except the slider 61. The main member 11 is configured to form the workpiece processing apparatus 10 together with the slider 61, the workpiece processing apparatus 10 being configured to use the hydraulic-pressure to process the workpiece 82 of the object 80. Thus, the main member 11 is a partial device 11 of the workpiece processing apparatus 10. In other words, the workpiece processing apparatus 10 comprises the partial device 11 which works as the main member 11 of the workpiece processing apparatus 10.

The main member 11 of the present embodiment comprises at least the base member 20, the punches 64 (see FIG. 2), the holders 65 (see FIG. 2), the holder-support members 66 (see FIG. 2), the spacers 72 (see FIG. 3) and the pistons 42 (see FIG. 3). Each member of the main member 11 has the already described structure and works as already described. For example, when the workpiece processing apparatus 10 is formed, the slider 61 is located above the base member in the upper-lower direction and is movable in the upper-lower direction between the upper position shown in FIG. 5 and the lower position shown in FIG. 9. The punches 64, the holders 65 and the spacers 72 are attachable to the slider 61. When the punches 64 are attached to the slider 61, the punches 64 project downward from the slider 61 and are moved in the upper-lower direction in accordance with the movement of the slider 61 in the upper-lower direction.

Referring to FIG. 2, the workpiece processing apparatus 10 of the present embodiment can be further variously modified in addition to the already described modifications. For example, the three workpiece processing members 62 of the present embodiment have shapes same as each other. However, the present invention is not limited thereto. For example, the three punches 64 may have diameters different from each other. In this instance, the workpiece processing chambers 51 (see FIG. 5) may have inner diameters which correspond to the punches 64, respectively.

What is claimed is:

1. A workpiece processing apparatus configured to use hydraulic pressure to process a workpiece of an object, the workpiece processing apparatus comprising:

a main member;

wherein:

the main member comprises a base member, a punch and a piston;

the base member is formed with a hydraulic chamber;

the hydraulic chamber is fillable with liquid;

the hydraulic chamber has a workpiece processing chamber and a hydraulic-pressure generation chamber;

the workpiece processing chamber and the hydraulic-pressure generation chamber are coupled together and have openings, respectively;

the openings open outward from the base member at positions different from each other;

the punch is movable between an initial position which is apart from the opening of the workpiece processing chamber and a received position at which the punch is partially received in the workpiece processing chamber through the opening of the workpiece processing chamber;

when the punch is moved from the initial position to the received position under a state where the opening of the workpiece processing chamber is covered by the workpiece, the punch presses the workpiece into the workpiece processing chamber;

the piston is partially received in the hydraulic-pressure generation chamber through the opening of the hydraulic-pressure generation chamber so that the piston is movable in the hydraulic-pressure generation chamber and partially projects from the hydraulic-pressure generation chamber; and the base member, the punch, and the piston are configured such that, when the hydraulic chamber is filled with the liquid, the piston receives a pressing force directed into the hydraulic-pressure generation chamber via a resilient member in a course of movement of the punch from the initial position to the received position, and the piston is moved in accordance with the pressing force and increases hydraulic pressure of the liquid.

2. The workpiece processing apparatus as recited in claim 1, wherein:

the workpiece processing apparatus comprises a slider;

the slider is located above the base member in an upper-lower direction and is movable between an upper position and a lower position in the upper-lower direction;

the punch projects downward from the slider and is configured to move in the upper-lower direction in accordance with a movement of the slider in the upper-lower direction;

each of the workpiece processing chamber and the hydraulic-pressure generation chamber extends in the upper-lower direction and opens upward;

the piston is partially received in the hydraulic-pressure generation chamber so that the piston is movable in the upper-lower direction and projects upward from the hydraulic-pressure generation chamber;

the piston receives the pressing force directed downward from the slider in a course of movement of the slider from the upper position to the lower position; and the slider, the punch, and the piston are configured such that, when the slider is moved from the upper position toward the lower position under a state where the hydraulic chamber is filled with the liquid and the workpiece is placed on the workpiece processing chamber, the punch is moved downward and presses the workpiece into the workpiece processing chamber, and the piston is moved downward in accordance with the pressing force and increases the hydraulic pressure of the liquid.

3. The workpiece processing apparatus as recited in claim 2, wherein:

the workpiece processing apparatus comprises two or more workpiece processing sets;

each of the workpiece processing sets includes the hydraulic chamber, the piston and the punch;

all the punches project downward from the single slider; and the hydraulic pressure of at least one of the workpiece processing sets is different from the hydraulic pressure of a remaining one of the workpiece processing sets at a predetermined timing.

4. The workpiece processing apparatus as recited in claim 3, wherein at least one of the pistons receives the pressing force from the slider at a timing different from another timing at which a remaining one of the piston receives the pressing force.

5. The workpiece processing apparatus as recited in claim 4, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

6. The workpiece processing apparatus as recited in claim 5, wherein:

the hydraulic chamber has a branch channel;

the branch channel branches off from the workpiece processing chamber and has an opening which opens outward from the base member; and when the holder presses the workpiece against the base member, the opening of the branch channel is located below the holder in the upper-lower direction and is located outward of a peripheral edge of the workpiece in the horizontal plane.

7. The workpiece processing apparatus as recited in claim 3, wherein:

each of the workpiece processing sets includes a spacer;

all the spacers project downward from the single slider;

each of the pistons receives the pressing force from the spacer in a course of movement of the slider from the upper position to the lower position;

when the slider is located at the upper position, each of the spacers is apart from the piston by a predetermined distance in the upper-lower direction; and at least one of the predetermined distances is different from a remaining one of the predetermined distances.

8. The workpiece processing apparatus as recited in claim 7, wherein:

each of the spacers comprises a pressing portion and the resilient member;

each of the pressing portions is configured to press the piston downward; and each of the resilient members has resiliency and supports the pressing portion so that the pressing portion is movable relative to the slider.

9. The workpiece processing apparatus as recited in claim 8, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

10. The workpiece processing apparatus as recited in claim 9, wherein:

the hydraulic chamber has a branch channel;

the branch channel branches off from the workpiece processing chamber and has an opening which opens outward from the base member; and when the holder presses the workpiece against the base member, the opening of the branch channel is located below the holder in the upper-lower direction and is located outward of a peripheral edge of the workpiece in the horizontal plane.

11. The workpiece processing apparatus as recited in claim 7, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

12. The workpiece processing apparatus as recited in claim 11, wherein:

the hydraulic chamber has a branch channel;

the branch channel branches off from the workpiece processing chamber and has an opening which opens outward from the base member; and when the holder presses the workpiece against the base member, the opening of the branch channel is located below the holder in the upper-lower direction and is located outward of a peripheral edge of the workpiece in the horizontal plane.

13. The workpiece processing apparatus as recited in claim 3, wherein:

each of the pistons has a body;

each of the bodies is partially received in the hydraulic-pressure generation chamber; and at least one of the bodies has a cross-sectional area different from another cross-sectional area of a remaining one of the bodies in a plane perpendicular to the upper-lower direction.

14. The workpiece processing apparatus as recited in claim 13, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

15. The workpiece processing apparatus as recited in claim 14, wherein:

the hydraulic chamber has a branch channel;

the branch channel branches off from the workpiece processing chamber and has an opening which opens outward from the base member; and when the holder presses the workpiece against the base member, the opening of the branch channel is located below the holder in the upper-lower direction and is located outward of a peripheral edge of the workpiece in the horizontal plane.

16. The workpiece processing apparatus as recited in claim 2, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

17. The workpiece processing apparatus as recited in claim 16, wherein:

the hydraulic chamber has a branch channel;

the branch channel branches off from the workpiece processing chamber and has an opening which opens outward from the base member; and when the holder presses the workpiece against the base member, the opening of the branch channel is located below the holder in the upper-lower direction and is located outward of a peripheral edge of the workpiece in the horizontal plane.

18. The workpiece processing apparatus as recited in claim 3, wherein:

the main member comprises a holder and a holder-support member;

the holder is located outward of the punch in a horizontal plane perpendicular to the upper-lower direction;

the holder-support member has resiliency and supports the holder so that the holder is movable relative to the slider; and when the slider is moved downward under a state where the workpiece is placed on the workpiece processing chamber, the holder is moved downward and presses the workpiece against the base member.

19. The workpiece processing apparatus as recited in claim 18, wherein:

the hydraulic chamber has a branch channel;

the branch channel branches off from the workpiece processing chamber and has an opening which opens outward from the base member; and when the holder presses the workpiece against the base member, the opening of the branch channel is located below the holder in the upper-lower direction and is located outward of a peripheral edge of the workpiece in the horizontal plane.

20. A main member for a workpiece processing apparatus configured to use hydraulic pressure to process a workpiece of an object, the main member comprising:

a base member;

a punch; and a piston;

wherein:

the base member is formed of a lower member, an upper member placed on the lower member, a die, and a cylinder combined together, and comprising a hydraulic chamber that is fillable with liquid;

the die and the cylinder have upper surfaces which are exposed from the upper member;

each of the die and the cylinder has a center hole;

the hydraulic chamber has a workpiece processing chamber that extends through the center hole of the die and a hydraulic-pressure generation chamber that extends through the center hole of the cylinder;

the workpiece processing chamber and the hydraulic-pressure generation chamber are coupled together and have openings, respectively;

the openings open outward from the base member at positions different from each other;

each of the workpiece processing chamber and the hydraulic-pressure generation chamber extends in an upper-lower direction and opens upward;

the punch is movable between an initial position which is located above the workpiece processing chamber and a received position at which the punch is partially received in the workpiece processing chamber along the upper-lower direction;

the piston is partially received in the hydraulic-pressure generation chamber so that the piston is movable in the upper-lower direction and projects upward from the hydraulic-pressure generation chamber;

the piston receives a pressing force directed downward in a course of movement of the punch from the initial position to the received position; and the punch and the piston are configured such that, when the punch is moved from the initial position toward the received position under a state where the hydraulic chamber is filled with the liquid and the workpiece is placed on the workpiece processing chamber, the punch is moved downward and presses the workpiece into the workpiece processing chamber, and the piston is moved downward in accordance with the pressing force and increases hydraulic pressure of the liquid.

* * * * *